US011028596B2

(12) United States Patent
Evans

(10) Patent No.: US 11,028,596 B2
(45) Date of Patent: Jun. 8, 2021

(54) FAÇADE SYSTEM

(71) Applicant: Ash & Lacy Holdings Limited, West Midlands (GB)

(72) Inventor: Jonathan Evans, Staffordshire (GB)

(73) Assignee: Ash & Lacy Holdings Limited, West Midlands (GB)

( * ) Notice: Subject to any disclaimer, the term of this patent is extended or adjusted under 35 U.S.C. 154(b) by 0 days.

(21) Appl. No.: 16/633,093

(22) PCT Filed: Jul. 24, 2018

(86) PCT No.: PCT/GB2018/052081

§ 371 (c)(1),
(2) Date: Jan. 22, 2020

(87) PCT Pub. No.: WO2019/020990

PCT Pub. Date: Jan. 31, 2019

(65) Prior Publication Data

US 2020/0173174 A1 Jun. 4, 2020

(30) Foreign Application Priority Data

Jul. 26, 2017 (GB) ..... 1712020

(51) Int. Cl.
*E04F 13/08* (2006.01)

(52) U.S. Cl.
CPC ..... *E04F 13/0803* (2013.01); *E04F 13/083* (2013.01); *E04F 13/0889* (2013.01)

(58) Field of Classification Search
CPC . E04F 13/0803; E04F 13/083; E04F 13/0825; E04F 13/12; E04F 13/18; E04F 13/0889; E04F 13/0864

(Continued)

(56) References Cited

U.S. PATENT DOCUMENTS 4,522,007 A * 6/1985 Oehlert ..... E04F 13/12 52/506.1
4,607,471 A * 8/1986 Olsen ..... E04F 13/0803 52/509

(Continued)

FOREIGN PATENT DOCUMENTS

EP 0967344 A2 12/1999
GB 1533567 A 11/1978

(Continued)

OTHER PUBLICATIONS

International Search Report issued by ISA/EPO in connection with PCT/GB2018/052081 dated Oct. 9, 2018.

(Continued)

*Primary Examiner* — Brent W Herring
(74) *Attorney, Agent, or Firm* — Levenfeld Pearlstein, LLC

(57) ABSTRACT

A plank (10) for a fagade system comprises a facia (12), a joining lip (20), and a hook (30). The joining lip (20) is recessed behind and extends alongside the facia (12) to overlap with an adjacent plank. The hook 30 extends behind the facia to engage a wall-mounted retainer (38, FIG. 3D). The plank 10 comprises a rail 26 to conceal the hook (30). In one aspect, the rail 26 extends beyond the hook to abut the wall, to restrict a tilt of the plank. In one aspect, the joining lip 20 comprises alignment features (22) for positioning another retainer (40, FIG. 3D). In one aspect, the facia (12) comprises blind grooves (52, FIG. 8B) mimicking inter-plank interstitial grooves. The aspects individually and combined reduce the resources required for covering a large wall area with aligned cladding facias.

16 Claims, 6 Drawing Sheets

(58) Field of Classification Search
USPC ..... 52/476, 479, 483.1, 489.1, 489.2
See application file for complete search history.

(56) References Cited

U.S. PATENT DOCUMENTS

| | | | | |
|---|---|---|---|---|
| 6,484,465 | B2 * | 11/2002 | Higgins | E04F 13/081 52/235 |
| 7,661,235 | B2 * | 2/2010 | Stoecker | E04F 13/12 52/478 |
| 8,745,941 | B2 * | 6/2014 | Macdonald | E04F 13/0891 52/235 |
| 9,145,689 | B2 * | 9/2015 | Deumer | E04F 13/0816 |
| 9,803,372 | B2 * | 10/2017 | Griffiths | E04F 13/083 |
| 10,253,507 | B1 * | 4/2019 | Bilge | E04F 13/0807 |
| 2010/0088988 | A1 | 4/2010 | Gaudreau | |
| 2011/0000160 | A1 * | 1/2011 | Sarayli | E04F 13/123 52/475.1 |
| 2011/0252731 | A1 * | 10/2011 | Boyer | E04F 13/007 52/302.1 |
| 2014/0161516 | A1 * | 6/2014 | Deumer | E04F 13/0823 403/345 |
| 2016/0102462 | A1 * | 4/2016 | Griffiths | E04F 13/0889 52/550 |
| 2016/0145875 | A1 * | 5/2016 | Scully | E04F 13/14 52/698 |
| 2016/0340909 | A1 | 11/2016 | Riebel et al. | |

FOREIGN PATENT DOCUMENTS

| | | | |
|---|---|---|---|
| GB | 2405878 | A | 3/2005 |
| WO | 08607402 | A | 12/1986 |
| WO | 2010050994 | A1 | 5/2010 |

OTHER PUBLICATIONS

Written Opinion issued by ISA/EPO in connection with PCT/GB2018/052081 dated Oct. 9, 2018.
GB Search Report issued by IPO in conneciton with GB1712020.5 dated Jan. 23, 2019.

* cited by examiner

FAÇADE SYSTEM

CROSS-REFERENCE TO RELATED APPLICATION DATA

This application is a US National Stage Application of PCT/GB2018/052081, filed 24 Jul. 2018, titled Façade System, which claims the benefit of and priority to Great Britain Application No. GB 1712020.5, filed 26 Jul. 2017, the disclosures of which are incorporated herein in their entirety.

FIELD OF THE INVENTION

This invention relates to extruded plank systems, typically made of extruded aluminium or plastics, for providing a weather-proof external covering to buildings such as an industrial building made principally of metal or concrete support beams which impart strength to the building, with the extruded plank system providing weather proofing, eg rain-protection cladding, and/or an aesthetically pleasing outward appearance.

BACKGROUND

Extruded plank systems for covering industrial buildings, or buildings in general, comprise a succession of extruded panels fixed to a wall structure such as an array of vertical beams, the planks being arranged in a side-by-side relationship to each other, secured in place to the wall structure by fasteners, which may typically be in the form of an insulating panel itself fixed to the wall structures via elongate fasteners driven therethrough.

Extruded planks are typically made of aluminium, with each successive panel being hooked at its lower end to engage the hooked end of a previously installed panel before being fixed in place, the panel typically being supported by being held in its desired position by a co-worker while the plank is secured in place with fasteners.

The present invention seeks to provide advanced mounting structures that maintain a sufficient degree of rigidity.

Prior to fixation to a walling structure, some effort is directed to ensuring that the planks are aligned as intended. For instance, rails may have to overlap to provide an effective rain screen or flashing, or to provide a neat appearance. To achieve a desired degree of alignment relative to a fixed plank (eg the fixed plank may be a lower plank of a succession of planks installed from the base to the top of a building), a co-worker may hold a spacer in place before positioning a successive plank, such that the spacer sits temporarily on the fixed (lower) plank to support the successive (upper) plank that sits on the spacer until it is fixed to the building. Once the successive plank is fixed to the building, the spacer can be removed and be used for the next plank. The spacer ensures an even interstitial joint spacing between adjacent planks. The alignment requirements increase with increasing façade areas and when smaller planks are used.

The present invention provides various aspects to facilitate existing cladding procedures.

SUMMARY OF THE INVENTION

In accordance with a first aspect of the present invention, there is provided a plank for an extruded plank façade system as defined in claim 1. The façade system comprises a plurality of such planks as cladding suitable for a vertical walling structure. The plank is of the type comprising a facia, a joining lip, and an attachment hook structure.

The joining lip is recessed behind the facia and extends along a side of the facia to be at least partially overlapped by an adjacent facia of another plank to be provided and to define at least part of a joint groove between the facia and the adjacent facia.

The attachment hook structure extends back behind the facia to allow the plank to engage, via the attachment hook structure, a retainer fixed to the walling structure.

The plank further comprises a rail to at least partially conceal the attachment hook structure.

In the first aspect, the rail extends back from the facia beyond the attachment hook structure, whereby, when the plank is attached to the walling structure by way of the attachment hook structure on the retainer, the rail abuts the walling structure, thereby limiting a tilt of the plank about the attachment hook structure.

In accordance with a second aspect of the present invention, there is provided a plank for an extruded plank façade system as defined in claim 2. The façade system comprises a plurality of such planks as cladding suitable for a vertical walling structure. The plank is of the type comprising a facia, a joining lip, and an attachment hook structure.

The joining lip is recessed behind the facia and extends along a side of the facia to be at least partially overlapped by an adjacent facia of another plank to be provided and to define at least part of a joint groove between the facia and the adjacent facia.

The attachment hook structure extends back behind the facia to allow the plank to engage, via the attachment hook structure, a retainer fixed to the walling structure.

The plank further comprises a rail to at least partially conceal the attachment hook structure.

In the second aspect, the joining lip comprises a plurality of alignment features for positioning another retainer to be provided, the other retainer to be engaged by an adjacent plank, wherein the alignment features are arranged on the joining lip at different distances from the facia such that aligning the other retainer with one of the alignment features defines an interstitial distance of the joint groove between the facia and the adjacent facia.

In some embodiments of the second aspect, the rail extends back from the facia beyond the attachment hook structure, whereby, when the plank is attached to the walling structure by way of the attachment hook structure on the retainer, the rail abuts the walling structure, thereby limiting a tilt of the plank about the attachment hook structure.

It is understood that the plank of the different aspects of the invention has a longitudinal extension. The principal parts of the plank can be described with reference to a cross-section perpendicular to the longitudinal extension.

The plank is intended for horizontal or vertical mounting to a vertical backing system, the backing system usually consisting of laterally spaced apart rails or mullions, by way of a retainer arrangement. The retainers of the retainer arrangement are mounted to the mullions with fasteners, such as bolts. In one arrangement described below, the retainer arrangement is provided by a bolt with integral retainer. The plank is positioned, by way of the attachment hook structure, on or against one or more retainers of the retainer arrangement.

It is understood that the joining lip extends along one side of the plank, usually along a longer elongate side of the plank, so as to be overlapped by an adjacent plank.

By walling structure, the underlying fix building structure is meant, and this may include previously installed planks.

As will be seen below, a successive plank abutting the walling structure may abut its preceding (lower) plank fixed to the building.

The retainer may be fixed to the walling structure via (through) a preceding plank. The retainer may fix the preceding plank to the walling structure and serve as support for the succeeding plank. The retainer may be provided by a structure of the preceding plank. The retainer can be positioned on the joining lip, such that the joining lip is fastened to the walling structure with the fastener of the retainer.

The rail may be part of a flashing structure, provided to overlap with an adjacent plank so as to improve the rainproof properties of the façade system.

The facia is understood to constitute the exterior side of the plank when installed on a building. The back of the plank is the building-facing side. When the plank is mounted to a walling structure of a building, a component on the back of the plank extends closer to the walling structure the further it extends back from the plank.

The invention facilitates the installation of multiple planks in an aligned fashion. The first aspect of the invention facilitates a temporary anchoring of a plank against the retainer, because once the attachment hook structure is held on or against the retainer, the rail provides a support leg function that inhibits a tilt of the plank about the retainer. The rail can be designed within tight tolerances to practically avoid tilting altogether, although it is understood that this may also depend to some extent on the smoothness of the walling structure. The rail may abut the joining lip of a preceding plank, and in that case the rail may be designed taking into account the sheet thickness of the corresponding joining lip.

For assemblies in which a subsequent plank is to be installed above another plank, the support leg has been found to temporarily prop up, and thereby stabilise, the subsequent plank sufficiently, even while the joining lip abuts the walling structure and before the joining lip is securely fixed to the walling structure. This allows the installation to be carried out by one person, rather than requiring a second person to maintain an alignment until the plank is securely fixed to the walling structure.

The second aspect of the invention facilitates the maintaining of one of several pre-defined distances between two adjacent facias. This avoids the need for a separate, temporary spacer component to be temporarily positioned between planks, because due to the alignment features on the lip of the plank, a permanent retainer to be provided can be relied on as providing the spacer function. Not requiring a temporary spacer component reduces the number of components to be carried or handled by a worker, and further reduces the requirement for a co-worker to assist with the installation of the cladding.

Any embodiments of the first and second aspects may be combined to facilitate the cladding installation procedure, because they allow the retainer to be used as alignment feature without the need for an additional alignment tool, such as a spacer. Thus, the installation time can be reduced as co-workers that would otherwise be required to assist with the installation of a cladding system can be redeployed to progress the cladding installation on a different wall section.

In some embodiments, the attachment hook structure has a contact level with the walling structure where it attaches to the retainer, wherein the rail has a contact level with the walling structure where it contacts the walling structure, and wherein the contact levels of the attachment hook structure and of the rail are spaced apart less than the width of the joining lip.

In other words, for two planks of the same design the joining lip of the first plank is at least as wide as the space between the engagement line of the attachment hook structure and the contact area of the rail with the walling structure. This ensures an overlap between two adjacent planks in a manner that, when a first and a second plank are installed adjacent to each other, the joining lip of a first plank extends at least to the attachment hook structure of the second plank.

In some embodiments, the joining lip comprises a plurality of lip protrusions or lip recesses, the lip protrusions or lip recesses constituting alignment features for said retainer.

In some embodiments, the lip protrusions are provided by ridges, and/or wherein, respectively, the lip recesses are provided by grooves.

The ridges and/or grooves may extend parallel to the edge of the facia. A feature extending in parallel is suitable for extruded planks.

In some embodiments, the plurality of lip protrusions or lip recesses, respectively, are unequally spaced apart with respect to the distance from the facia.

Unequally spaced apart alignment features help to ensure the correct alignment of the retainer with the joining lip. As set out below, the retainer-to-be-provided may comprise alignment features that are correspondingly unequally spaced apart in a manner that allow the retainer to positioned on the joining lip in one of only a few configuration options.

In some embodiments, the attachment hook structure comprises a retainer-engaging face that is inclined relative to the plank plane, such that, the deeper the attachment hook structure is set into the retainer, the closer the plank is held on the walling structure.

This facilitates the engagement of a plank with the retainer on the walling structure by allowing the plank to slot into the retainer. Once fully engaged, the plank can be assumed to be aligned, as much as practically possible, with the walling structure and with the previous plank.

In some embodiments, the facia comprises an outer flat that, when the plank is mounted to the walling structure, faces away from the walling structure, and the facia comprises on the outer flat one or more facia grooves extending parallel to the joining lip.

The facia grooves provide one or more blind joints and, thereby, when installed to a walling structure, a single plank may provide an impression of the presence of multiple planks spaced apart by even interstitial joint grooves, without requiring multiple planks. This allows larger planks to be used for larger areas in combination with smaller planks where required. This facilitates the provision of a uniform cladding while reducing the installation effort.

In accordance with a third aspect of the present invention, there is provided a plank for an extruded plank façade system as defined in claim 10. The façade system comprises a plurality of such planks as cladding suitable for a vertical walling structure. The plank is of the type comprising a facia, a joining lip, and an attachment hook structure.

The joining lip is recessed behind the facia and extends along a side of the facia to be at least partially overlapped by an adjacent facia of another plank to be provided and to define at least part of a joint groove between the facia and the adjacent facia.

The attachment hook structure extends back behind the facia to allow the plank to engage, via the attachment hook structure, a retainer fixed to the walling structure.

In the third aspect, the facia comprises an outer flat that, when the plank is mounted to a walling structure, faces away from the walling structure, and wherein the facia comprises on the outer flat one or more facia grooves extending parallel to the joining lip.

Any embodiments of the third aspect may be combined with embodiments of the first aspect and/or the second aspect. The third aspect reduces the need for additional alignment tools because a single plank provides the impression of a two or more aligned planks.

When embodiments of the third aspect are combined with embodiments of the first aspect, this further facilitates the installation of aligned planks, because a support-leg-providing rail improves the stability even of a relatively larger plank during temporary positioning, and so larger planks may be used instead of plurality of smaller planks that would otherwise be required to cover the same area.

When embodiments of the third aspect are combined with embodiments of the second aspect, this further facilitates the installation of aligned planks, because alignment features on the joining lip help to ensure that the interstitial groove space between plank facias (ie the inter-facia groove distance) corresponds to the one or more facia grooves within a plank (ie to the intra-facia groove distance).

In some embodiments, the joining lip is recessed behind the flat of the facia by a lip depth, and wherein the one or more facia grooves have a facia groove depth practically corresponding to the lip depth.

In some embodiments, the one or more facia grooves divide the facia into facia strips of practically equal width.

In accordance with a fourth aspect of the present invention, there is provided a plank arrangement for an extruded plank façade system as defined in claim 13. The plank arrangement comprises a plank according to any embodiment of the first, second or third aspect, and said retainer. The retainer comprises an attachment mechanism allowing the retainer to be fixed to a walling structure, a retaining lip for engagement with the attachment hook structure, and a spacing element defining a distance between the walling structure and the retaining lip when the plank is installed on the walling structure.

In some embodiments, the retainer comprises one or more retainer protrusions and/or retainer recesses for alignment with corresponding lip recesses and/or lip protrusions on the joining lip of the plank.

In some embodiments, the attachment mechanism comprises a bolt comprising a bolt head arrangement providing the spacing element and the retaining lip.

The bolt and the bolt head arrangement may be unitary, made from the same material. The bolt head arrangement may be made from a different material than the bolt. For instance, the bolt head arrangement may be overmoulded onto a bolt.

In some embodiments, the bolt head arrangement comprises a flange extending around at least part of the circumference of the bolt head to provide the retaining lip.

In some embodiments, the spacing element of the bolt head arrangement is provided by a portion of a shaft of the bolt.

In some embodiments, the retainer is dimensioned to be smaller than the space between the attachment hook structure and the rail, thereby avoiding interference of the retainer with the rail's abutment with an underlying walling structure when the attachment hook structure is held on the retaining lip.

In some embodiments, the retaining lip comprises an inclined plank-engaging face to engage the attachment hook structure, such that, the deeper the attachment hook structure is set into the tapered plank-engaging face, the closer the plank is held on the walling structure.

Also disclosed herein is a retainer as described above, ie a retainer in isolation of a plank arrangement. Different variants of the retainer may comprise any one of the features described above. For instance, in one retainer variant, the retainer comprises a bolt comprising a bolt head arrangement providing the spacing element and the retaining lip. The spacing element is provided by portion of the shaft of the bolt head. The retaining lip is provided by at least a portion of the flange of the bolt head arrangement. The retaining lip may comprise a tapered plank-engaging face. The plank-engaging face may be a frustoconical portion of the bolt head arrangement facing in the direction of the tip of the bolt. Characteristically for a retainer used in the invention, the tapered plank-engaging face portion of the bolt head is on the underside of the bolt head, the underside being the side from which the bolt shaft extends. The retainer variant comprising a bolt is distinguished from a countersunk screw in that that the bolt head comprises a spacing element on a portion of the shaft of the bolt, which spacing element has a wider cross-section that the shaft. For instance, the spacing element may be a stepped portion of the shaft or of the bolt head that provides an annular seating surface to abut the walling structure. The retainer variant comprising a bolt is distinguished from a screw-in drawer handle in that the plank-engaging face portion of the bolt head has a straight, frusto-conical surface, so as to allow a retainer-engaging attachment hook structure to slide onto the retainer. Furthermore, the circumferential outer surface of the bolt head is cylindrical so as to provide a seating surface or contact line perpendicular to the shaft.

The plank may be made from aluminium. The properties may be according to EN AW-6063T6 and BS EN 755-2: 1997.

The plank may be provided with an anodised finish.

DESCRIPTION OF THE FIGURES

Exemplary embodiments of the invention will now be described with reference to the Figures, in which.

DESCRIPTION

Figure 1:
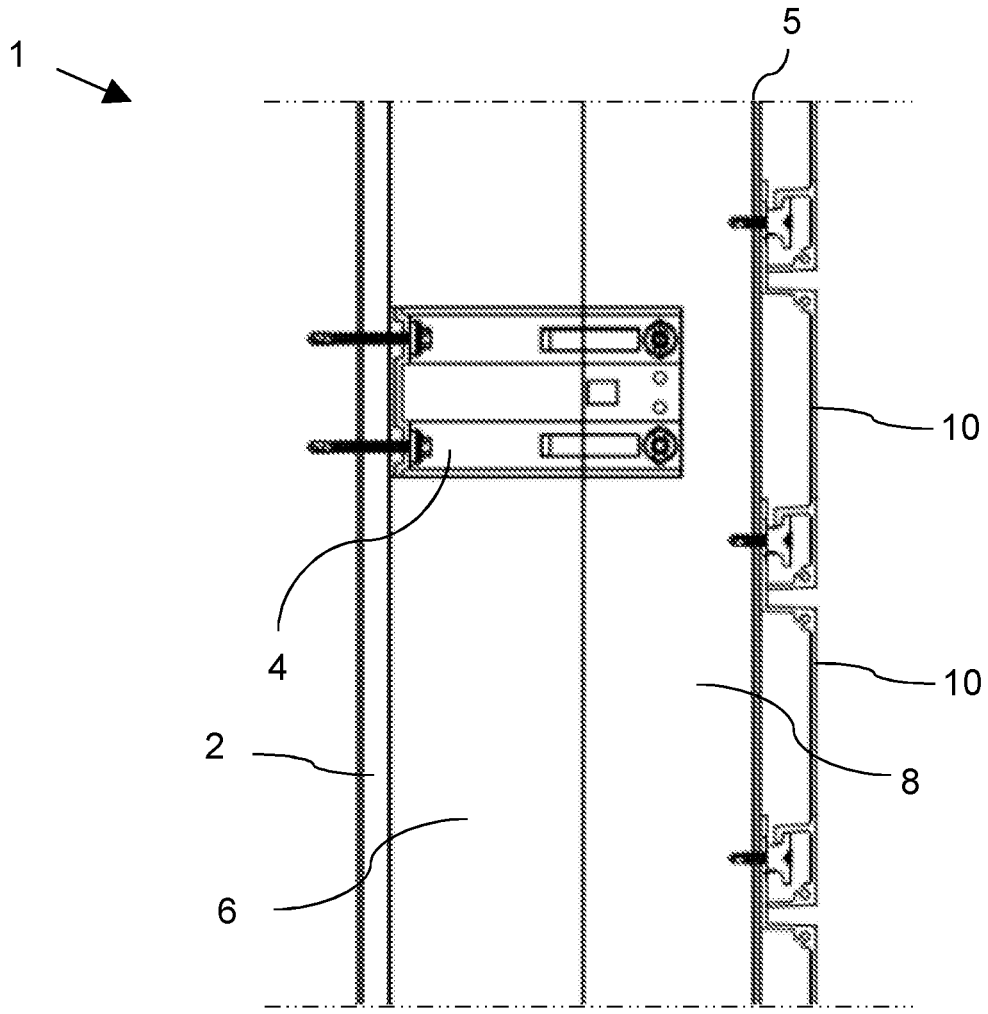
FIG. 1 shows a side section view of a part of a plank façade system in accordance with embodiments of the invention.

FIG. 1 shows an overview of selected elements of a walling structure 1 onto which a planks of the invention are installed as a façade system. The walling structure is part of, or attached to, a building. In the reading orientation of FIG.

1, the interior side of the building is on the left side and the exterior side is right. The walling structure comprises a building wall 2, such as cementitious board. Onto the outside (ie, to the right in the reading orientation of FIG. 1) of the building wall 2 is mounted via mullion brackets 4 a succession of mullions 8 (only one mullion 8 is shown in FIG. 1). The mullion brackets 4 hold the mullions 8 spaced from the building wall 2, set apart by a space 6. Insulation material may be provided in the space 6. The external side of the mullions 8 defines a plane 5 on which elements can be mounted perpendicularly to the mullions. It is understood that the plane 5 is typically not a continuous surface area, but defined by a succession of spaced-apart mullion surfaces. Across the spaced apart mullions 8 there are mounted a series of planks 10 to provide the outer cladding for the building wall 2.

Figure 2:
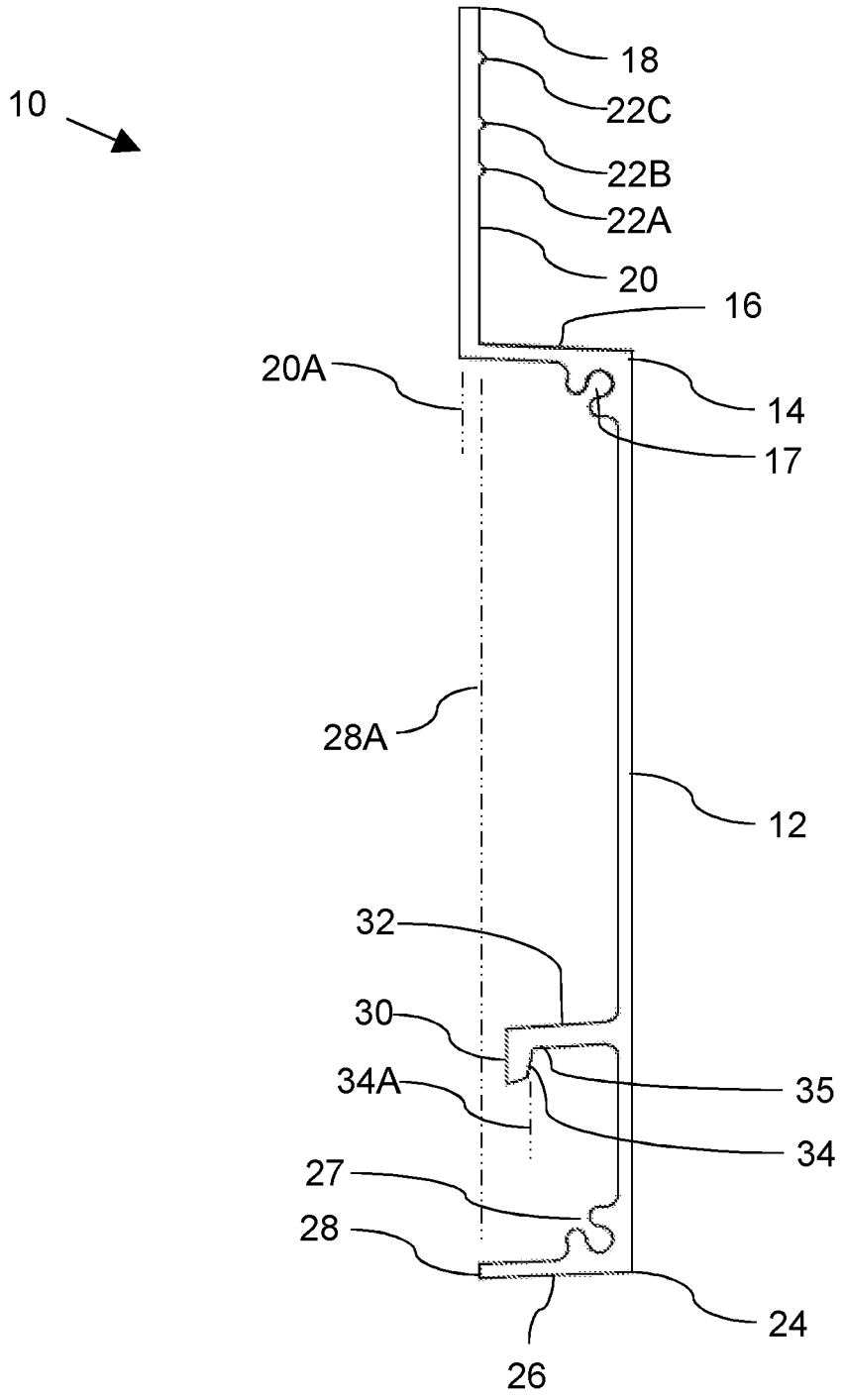
FIG. 2 shows a side view of an embodiment.

FIG. 2 shows a side view of a plank 10 of the invention. The plank 10 is extruded and has a uniform cross-section along its longitudinal extent, and so the features of the plank 10 can be described with reference to the side view. To provide an illustration of the dimensions of the plank. the longitudinal extent of the plank may be in the region of one or a few metres, as a trade-off between covering a large length while remaining suitable for handling by a single person. The plank may be manufactured to, or cut to, less than a metre as and when required. The plank may have any height but will typically be in the region of 10 to 40 cm high. The plank is in the region of about 2-3 cm deep from wall-abutting surface to facia surface, and the sheet thickness may be in the region of 3 mm.

The external side is understood to be the side facing away from the building to which the plank 10 is mounted. In the Figures, the plank 10 is depicted with its external side on the right (right in the reading orientation of the Figures) and with the side to be mounted to a building on the left. The plank 10 comprises a generally flat main surface 12 constituting a facia, extending from a first facia edge 14 to a second facia edge 24. If installed as shown in FIGS. 1 and 2, the first facia edge 14 is the top edge of a facia and the second facia edge 24 is the bottom edge of a facia.

At the first facia edge 14 the plank comprises a Z-bend backwards (backward with reference to the facia being the front side of the plank), the middle section of the Z-bend providing a first side wall 16 and the end section of the Z-bend providing a shelf 20. The first side wall 16 is angled at about a right angle (here, about 93 degrees included angle) relative to the main surface 12 and the shelf 20 is angled back by the same degree so as to extend parallel to the main surface 12, away from the main surface 12 and ending in a first plank edge 18. Due to the Z-bend, the shelf 20 is recessed behind the main surface 12 and extends along a side (here, the side constituted by the first facia edge 14) of the facia. The shelf 20 constitutes a joining lip to be overlapped by an adjacent plank. On the outer surface of the shelf 20 there are provided a plurality of ridges 22 (here: three ridges 22A, 22B, 22C). The ridges 22 are spaced apart between the first side wall 16 and the first plank edge 18. Each ridge 22 has a different distance relative to the first facia edge 14; a first ridge 22A is closest to the first facia edge 14, a second ridge 22B is further away and a third ridge 22C is furthest from the first facia edge 14. The first distance between the first ridge 22A and the second ridge 22B is less than the second distance between the second ridge 22B and the third ridge 22C. Eg, the first distance may be 7 mm and the second distance may be 10 mm. The ridges 22 constitute alignment features of the invention. Due to the different distances the ridges 22 are unequally spaced apart with respect to the first facia edge 14.

Turning to the lower end, at the second facia edge 24 the plank comprises a second side wall 26 that extends back behind the main surface 12 and ends in a second plank edge 28. The second side wall 26 is angled at a practically right angle (here: about 93 degrees included angle) and constitutes a rail of the invention. The second side wall 26 provides a flashing function and could be referred as flashing rail. The second plank edge 28 provides an abutment edge for abutting an underlying surface, as will be described below.

Opposite the external side of the main surface 12, ie inside the plank 10, between the first side wall 16 and the second side wall 26, spaced apart about 3 times further from the first side wall 16 than from the second side wall 26, there is provided a leg 32 extending back from the plank 10 and ending in a bend 30. The bend 30 constitutes an attachment hook structure and comprises on the inside of the bend 30 a retainer-engaging surface 34, generally parallel to although somewhat inclined to the main surface 12, and a retainer-seating surface 35, generally perpendicular to the main surface 12. The retainer-engaging surface 34 is inclined relative to the main surface, such that, the deeper the attachment hook structure is set into the retainer (to be provided), the closer the plank is held to a wall. The retainer-seating surface 35 is provided to rest on the retainer to be provided. The leg 32 extends at an approximately right angle from the back of the main surface 12 (here: about 93 degrees included angle between the first facia edge 14 and the bend 30. The leg 32 is approximately parallel to the second side wall 26.

On the rear side of the plank 10 between the first side wall 16 and the main surface 12 there is provided a first double-lip structure 17. Likewise, on the rear side of the plank between the second side wall 26 and the main surface 12 there is provided a second double-lip structure 27. The first double-lip structure 17 and the second double-lip structure 27 each provide a cross-section providing a lateral screw-hole behind the facia, and are provided to allow structures such a lateral finishing rail to be mounted to the lateral end of a plank.

In FIG. 2, a reference line 28A indicates the distance of the second plank edge 28 from the main surface 12 and a reference line 34A indicates the distance of the retainer-engaging surface 34 from the main surface 12. The second plank edge 28 is further away from the main surface 12 than the retainer-engaging surface 34 because the second side wall 26 extends back from the main surface beyond the retainer-engaging surface of the attachment hook structure.

Furthermore, a reference line 20A indicates the rear surface of the shelf 20 that is to come into abutment with a walling surface. The reference line 28A is closer to the main surface 12 than the reference line 20A by a distance corresponding to the sheet thickness of the shelf 20. For instance, for planks with a sheet thickness of 3 mm, the second plank edge 28 may be about 3 mm shorter than the wall-abutting rear side of the shelf 20. This means that the second plank edge 28 extends back as far as the external surface of the shelf 20. As illustrated below, this arrangement achieves that second plank edge 28 of a subsequent plank sits flush on the shelf 20 of a preceding plank. For a first plank, ie a plank that is installed without a preceding plank, it is an option to use a starter bar of the same sheet thickness (eg, 3 mm), to ensure a flush abutment.

It will be appreciated that the elements and components of the plank 10 are of unitary character as the plank 10 is extruded. Elements of the plank 10, such as the ridges 22, or the leg 32 with the hook arrangement, can be manufactured in a single extrusion process, with a uniform cross section along the longitudinal extent of the plank 10, without requiring subsequent pressing or stamping. This facilitates the manufacture of the plank 10.

Turning now to FIGS. 3A to 3D, there is illustrated a sequence of installation steps for a succession of planks 10 (here: two planks 10A and 10B) onto a plane 5. The plane 5 may be defined by a series of spaced-apart mullions, as described in relation to FIG. 1. Attached to the plane 5 is, by way of a bolt 38A, a retainer 38. The retainer 38 is a starter bar provided to support the first plank. Together with the elements defining the plane 5, the retainer 38 is considered a part of a walling structure. For the purposes of FIGS. 3A-3D, it suffices to appreciate that the retainer 38 comprises a lip suitable to receive in sliding engagement a retainer-engaging surface of a plank 10.

Figures 3A, 3B, 3C, 3D:
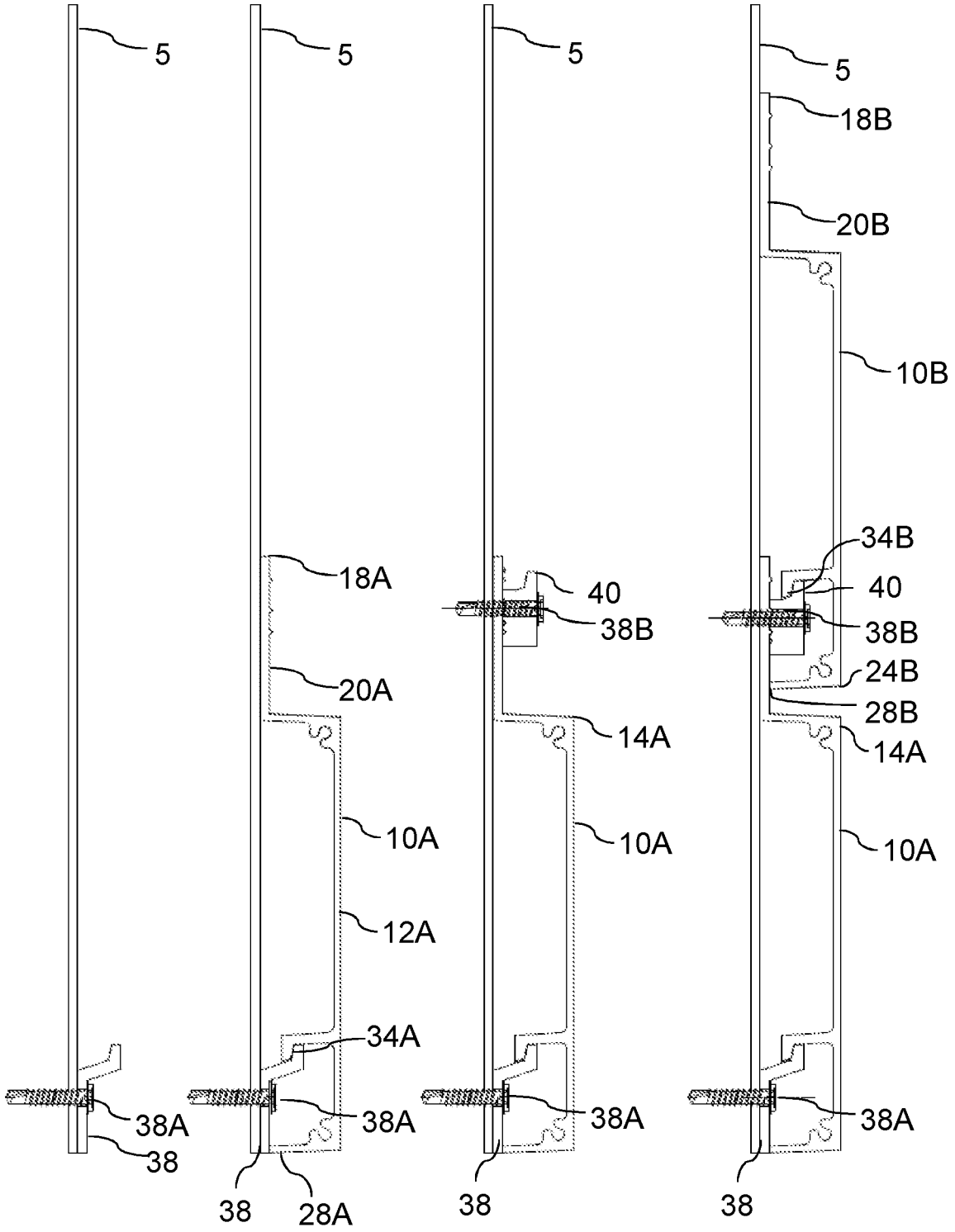
FIGS. 3A to 3D show side views illustrating assembly steps of a plank façade system in accordance with the invention.

Turning to FIG. 3B, a first plank 10A is hooked to the retainer 38 by way of the attachment hook structure, constituted by the retainer-engaging surface 34A, engaging the lip of the retainer 38. The engaging surfaces of the attachment hook structure and of the retainer are each inclined relative to the plane 5, or, respectively, relative to the main surface 12A of the first plank 10A, and so the first plank 10A is drawn closer to the plane 5 the deeper the attachment hook structure is set in the retainer.

It is worth appreciating that the retainer-engaging surface 34A faces, although being tapered, generally in the direction of the facia, and that the corresponding plank-engaging surface of the retainer faces, although being tapered, generally in the direction of the plane 5. This is due to the hooked engagement of the retainer-engaging surface with the plank-engaging surface.

In FIG. 3B the plank 10A sits on the retainer 38 and the second plank edge 28A abuts the walling structure (ie it abuts a surface of the fixed retainer 38), whereby the plank 10A is propped up. The second plank edge 28A inhibits a tilting forward of the plank 10A, and restricts a tilting of the first (here: top) plank edge 18A away and forward from the plane 5. A tilting might otherwise occur because the attachment hook structure is positioned nearer the lower end than the top end (here: about 3 times as far from the first facia edge than from the second facia edge), and so there is more mass above the retainer-engaging surface than below. Surprisingly, the plank 10A is securely propped up by way of this configuration such that, in trials, it was not necessary for a co-worker to hold the plank 10A against the plane 5 before the plank 10A is secured by fixing means. It will be appreciated that without a retainer 38 forming part of the walling structure, a tilt of the plank 10A is still limited. With an appropriately designed retainer 38 in place, a tile of the plank 10A can be practically prevented.

Turning now to FIG. 3C, the plank 10A is fixed to the plane 5 by way of a second bolt 38B engaging at the level of the shelf 20A. The second bolt 38B is further used to secure another retainer 40 to the shelf 20A. In practice, this allows the other retainer 40 to be mounted to the plane 5 in the same action that is carried out to secure the first plank 10A to the plane 5. The plank 10A is now considered to be part of the walling structure. Furthermore, because the plank comprises an alignment arrangement (see alignment features 22A-22C in FIG. 2), this facilitates that the retainer 40 is aligned at a pre-determined distance relative to the first facia edge 14A. No additional temporary spacer is required to set the distance between the plank 10A and a succeeding plank. The alignment will be described below.

In FIG. 3D, a second plank 10B is attached to the other retainer 40. The plank 10B has the same configuration as the plank 10A and corresponding features are designated by a suffix "-B" instead of a suffix "-A". Similarly to the first plank 10A engaged in the first retainer 38, the second plank 10B is slotted into the other retainer 40 and propped up by way of the second plank edge 28B, such that the second plank 10B is held in place without requiring the assistance of a co-worker. The second plank edge 28B abuts the shelf 20A of the first plank 10A, now part of the walling structure. The second plank 10B can be bolted to the plane 5, together with a third retainer (not shown) to continue the cladding process.

Furthermore, the second plank 10B is aligned (here: vertically aligned) with the first plank 10A. The interstitial space between the second facia edge 24B of the second plank 10B is at a pre-defined distance to the first facia edge 14A of the first plank 10A. This facilitates the installation of a pre-defined joint groove distance between the two planks.

The advantage of the tilt-limiting, plank-propping rail, constituted by the second plank edge 28 (in FIG. 3B: second plank edge 28A; in FIG. 3D: second plank edge 28B), is that taller planks may be used than would otherwise be possible safely. In particular, the retainers (in FIG. 3B: retainer 38; in FIG. 3D: retainer 40) can be dimensioned and positioned towards the lower end of a plank without requiring a counterbalancing temporary securing means (eg, a temporary retainer or assistance by a co-worker).

The retainers 38 and 40 have different designs. Retainer 38 is a starter bar and intended to support the first (here: lower) plank 10A, and is fixed directly to the plane 5, and not fixed onto a preceding plank. As such, the retainer 38 is wider, ie protrudes from the plane 5 further, than subsequent retainers, by an amount corresponding to the sheet thickness of the shelf 20. This is to ensure that the plank-engaging surface of each retainer protrudes the same distance relative to the plane 5. The other retainer 40 is provided for a succession of planks and is intended to be fixed to a preceding plank. As such, the retainer 40 comprises alignment features for alignment with a preceding plank. The starter bar does not require the same alignment features, although it may be provided with alignment features.

Turning now to FIGS. 4A to 6B, different clamping blocks 40A, 40B and 40C are described. Each clamping block 40A, 40B, 40C constitutes a retainer for use with the invention.

Figure 4A:
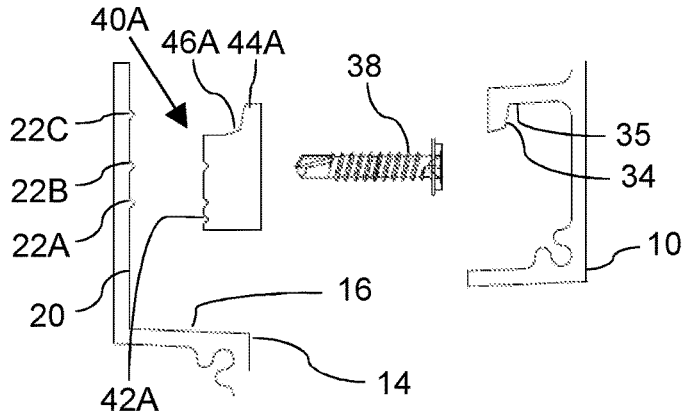
FIGS. 4A and 4B show a retainer arrangement for use with embodiments of the invention.

FIG. 4A is an exploded view showing the shelf 20 of a first plank, and part of a second plank 10B with a retainer-engaging surface 34 and a retainer-seating surface 35, and further a clamping block 40A and a separate bolt 38. The clamping block 40A constitutes a retainer. The clamping block 40A is a block of 11 mm depth and 24 mm height (from base to lip). The clamping block has a length of about 25 mm (not visible in the side view of FIG. 4A). On one side (the top side as illustrated in FIG. 4A), the clamping block 40A comprises, on the side to be facing away from the plane 5 when mounted to a structure, a protrusion 44A constituting a retaining lip. On the rear (walling-structure-facing) side the protrusion 44A is tapered, or inclined relative to the plane 5, thereby to provide an inclined plank-facing edge. The protrusion 44A is spaced from the rear (walling-structure-facing) side of the clamping block 40A by a spacer 46A. On its rear side, the clamping block 40A comprises a plurality (here: three) grooves 42A each constituting a retainer recess providing an alignment feature for alignment with one or more of the ridges 22A, 22B, 22C of the shelf 20. The ridges are unequally spaced apart from the first facia edge 14. The grooves 42A are unequally spaced apart and permit a tight seating of the clamping black 40A on ridges 22 of the shelf 20 only in a few configurations (see FIGS. 7A to 7C).

Figure 4B:
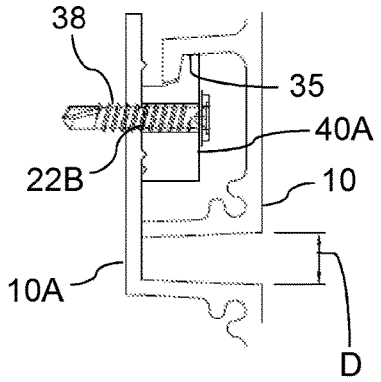

FIG. 4B shows the clamping block 40A fixed to the shelf 20 with the bolt 38, using the ridge 22B as alignment feature, and with a second plank 10 hooked onto the clamping block 40A. FIG. 4B shows that the interstitial groove distance D between the planks is determined by the position of the clamping block 40A on the alignment feature of the preceding plank. Eg, if the clamping block 40A is mounted closer to the first facia edge (ie lower), because it is aligned with the ridge 22A instead of the ridge 22B or 22C, the interstitial groove distance is shorter. If the clamping block 40A is mounted further away from the first facia edge (ie higher), the interstitial groove distance is longer. Furthermore, the retainer-seating surface 35 sits on the protrusion 44A (see FIG. 4A) of the clamping block 40A and this achieves a good alignment of the retainer-seating surface 35 relative to the first plank 10.

Figure 5A:
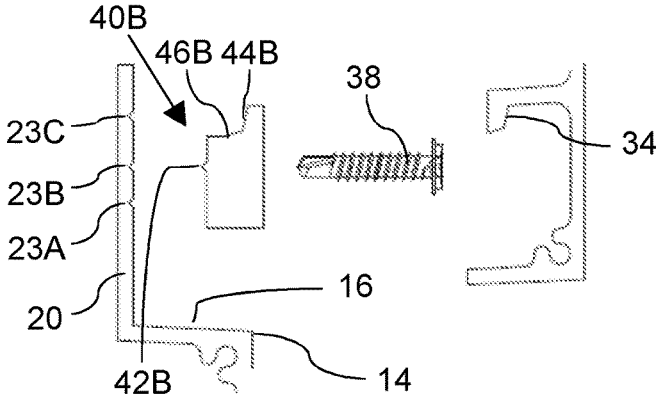
FIGS. 5A and 5B show another retainer arrangement for use with embodiments of the invention.
Figure 5B:
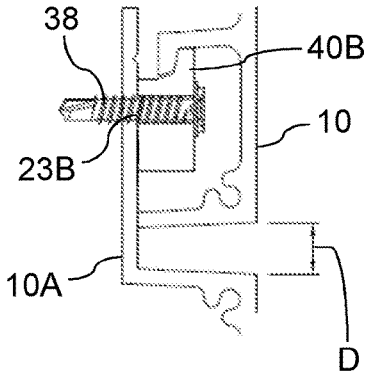

FIGS. 5A and 5B show an arrangement corresponding, except for differences set out below, to the arrangement of FIGS. 4A and 4B. The same numerals are used for corresponding elements. Instead of ridges 22A, 22B, 22C, the shelf 20 in FIG. 5A comprises a plurality (here: three) of grooves 23A, 23B, 23C. The grooves are unequally spaced apart from the first facia edge 14. The clamping block 40B is a block of 11 mm depth and 24 mm height (from base to lip) and has a length of about 25 mm (not visible in the side view of FIG. 5A). On one side (the top side as illustrated in FIG. 5A), the clamping block 40B comprises a protrusion 44B constituting a retaining lip. On the rear (walling-structure-facing) side the protrusion 44B is tapered, thereby to provide an inclined plank-facing edge. The protrusion 44B is spaced from the rear (walling-structure-facing) side of the clamping block 40B by a spacer 46B. On its rear side the clamping block 40B comprises a ridge 42B constituting a retainer protrusion providing an alignment feature for alignment with one of the grooves 23A, 23B, 23C of the shelf 20. It can be appreciated that the distance of the clamping block 40B relative the first facia edge 14 depends on which one of the grooves 23A, 23B, 23C is engaged by the ridge 42B.

FIG. 5B shows the clamping block 40B fixed to the shelf 20 with a bolt 38, using the groove 23B as alignment feature, and with a second plank 10 hooked onto the clamping block 40B. The interstitial groove distance D between the planks is determined by the position of the clamping block 40B on the alignment feature of the preceding plank.

Figure 6A:
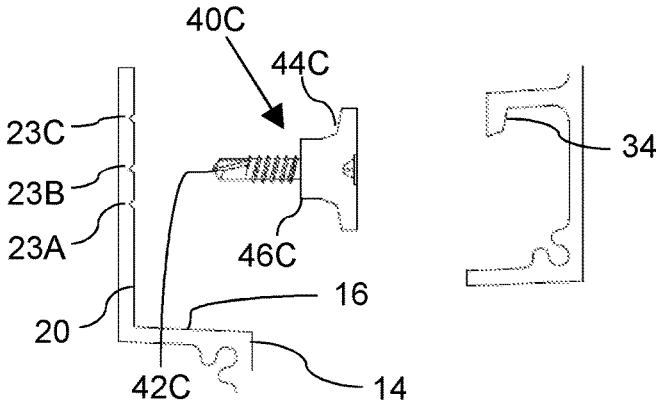
FIGS. 6A and 6B show another retainer arrangement for use with embodiments of the invention.
Figure 6B:
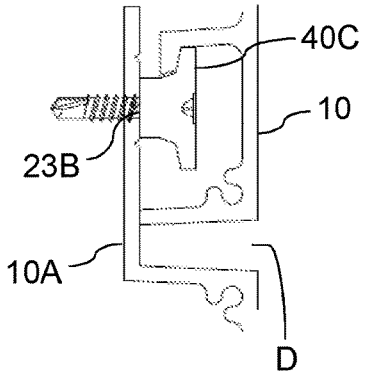

FIGS. 6A and 6B show another arrangement alternative to the arrangement shown in FIGS. 5A and 5B. The same numerals are used for corresponding elements. Instead of a clamping block 40B, the FIG. 6A arrangement shows a fixing screw 40C that is configured to provide the function of a clamping block. The fixing screw 40C constitutes an attachment mechanism with a bolt head comprising a circumferential flange 44C. The circumferential flange 44C constitutes a retaining lip. The bolt head is stepped relative to the thread portion to provide a seating face 46C that constitutes a spacing element defining a distance between the walling structure (ie the external surface of the shelf 20) and the retaining lip. The fixing screw 40C comprises a tip 42C that provides an alignment feature with one of the grooves 23A, 23B or 23C of the shelf 20.

FIG. 6B shows the fixing screw 40C fixed to the shelf 20, using the groove 23B as alignment feature, and with a second plank 10 hooked onto the fixing screw 40C. The interstitial groove distance D between the planks is determined by the position of the fixing screw 40C on the alignment feature of the preceding plank. The advantage of the circumferential flange 44C, or a flange that extends over at least a portion of the circumference of the bolt head, is that it provides an upward-facing lip feature regardless of the angular orientation of the retainer relative to the bolt axis. Furthermore, instead of a contact line, the circular flange provides a contact point for an attachment hook structure, which further reduces potential misalignment.

Furthermore, the provision of a fixing screw reduces the number of components a worker has to handle. Ie, instead of bolts and clamping blocks, a worker requires only bolts comprising a bolt head arrangement that provides the retainer functionality.

Figure 7A:
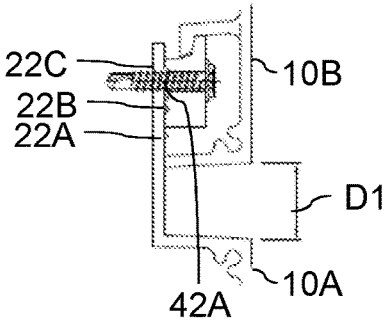
FIGS. 7A to 7C show different embodiments of the invention.
Figure 7B:
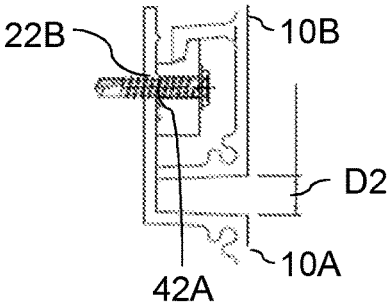
Figure 7C:
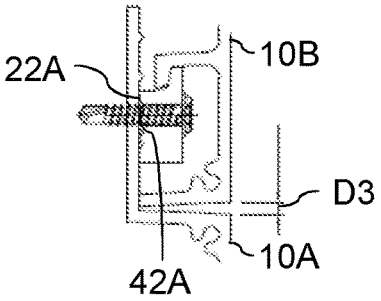

FIGS. 7A, 7B and 7C show three configurations derived from the alignment features. Continuing from the example shown in FIGS. 4A and 4B, FIGS. 7A to 7C show three different groove distances D1, D2 and D3, respectively, that can be set by positioning a clamping block (or fixing screw) relative to the ridges 22A, 22B, or 22C of the joining lip.

In a first configuration, shown in FIG. 7A with reference to FIG. 4A, the first and third grooves 42A (see also FIG. 4A) engage with the second and third ridges 22B and 22C. In the first configuration, the second groove and the first ridge 22A do not engage and are also positioned to avoid interfering with the coupling of the engaging ridges and grooves. The first configuration sets a groove distance D1.

In a second configuration, shown in FIG. 7B with reference to FIG. 4A, the first and second grooves 42A (see also FIG. 4A) engage with the first and second ridges 22A and 22B. In the second configuration, the third groove and the third ridge do not engage and are also positioned to avoid interfering with the coupling of the engaging ridges and grooves. The second configuration sets a groove distance D2 that is less that the groove distance D1.

In a third configuration, shown in FIG. 7C with reference to FIG. 4A, the first groove 42A (see also FIG. 4A) engages with the first ridge 22A. In the third configuration, the second and third grooves and the second and third ridge do not engage and are also positioned to avoid interfering with the coupling of the engaging ridge and groove. The third configuration sets a groove distance D3 that is less that the groove distances D1 or D2.

It will be understood that the configurations of FIGS. 7A, 7B and 7C could be achieved with the clamping block 40B shown in FIGS. 5A and 5B, or with the fixing screw 40C shown in FIGS. 6A and 6B.

To better appreciate the benefit if the alignment features 22, 23, and 42, it is worth bearing in mind that a plank may be several metres long but may be positioned with the help of a few retainers, each only a few centimetres wide, spaced apart along the length of the plank. As such, one retainer may be in the region of one or more metres spaced from the next retainer for the same plank. It would in the absence of alignment features be difficult for a worker not to accidentally position two retainers at different height levels, eg, one retainer at a correct (intended) height, eg height level A, and to position another retainer at a wrong height, eg height level B. Due to the tolerances, a slight offset may not be discovered at the time of installation. A provision allowing a worker to rely on the correct positioning of a few, predefined alignment features helps to avoid misalignment problems. In the particular example, there are only 3 different levels (here: top, middle, base) at which a clamping block can be mounted, which reduces, and practically eliminates, the risk of an alignment error. There may be a small number, such as 2, 3, 4 or 5 alignment positions, to assist with the positioning of the retainer. Furthermore, the unequal spacing further assists the eye in identifying the correct alignment position, as can be imagined. For instance, for a group of six alignment features (ridges or grooves) each vertically equally spaced apart, it may be possible to accidentally confuse the third and fourth feature. If at least a few of the features are unequally spaced apart, eg in three groups of two features, the eye can identify the third and fourth line as the upper line of the middle group or the lower line of the middle group, and in practice the unequal spacing therefore reduces the risk of misalignment.

Figure 8A:
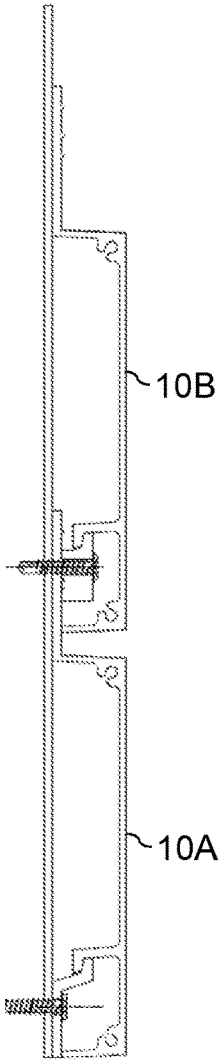
FIGS. 8A to 8D show side views illustrating further embodiments of the invention.

The sequence of FIGS. 8A to 8D is provided to illustrate embodiments comprising one or more facia grooves to provide the impression of a plurality of aligned planks. To provide a context for the embodiments, FIG. 8A is provided as a copy of the arrangement shown in FIG. 3D, showing however only reference numerals 10A and 10B of a first and second plank, respectively. As such, FIG. 8A shows a plurality (here: two) planks to cover a given surface area.

Figure 8B:
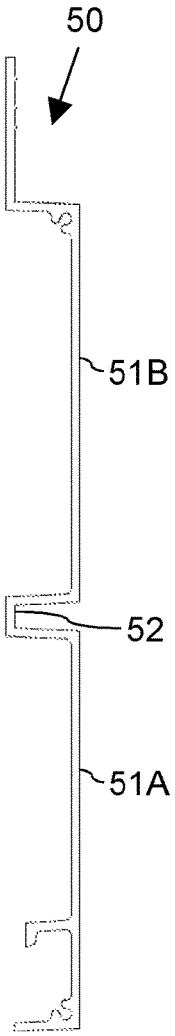

FIG. 8B shows a single plank 50 that corresponds in principle to the plank 10 illustrated in FIG. 2. The plank 50 comprises between the first facia edge and the second facia edge a facia groove 52 that divides the facia into a first facia strip 51A and a second facia strip 51B. The facia groove 52 extends parallel to the facia edges and is positioned half-way between the first facia edge and the second facia edge, and so the first and second facia strips 51A, 51B have about equal height.

Figure 8C:
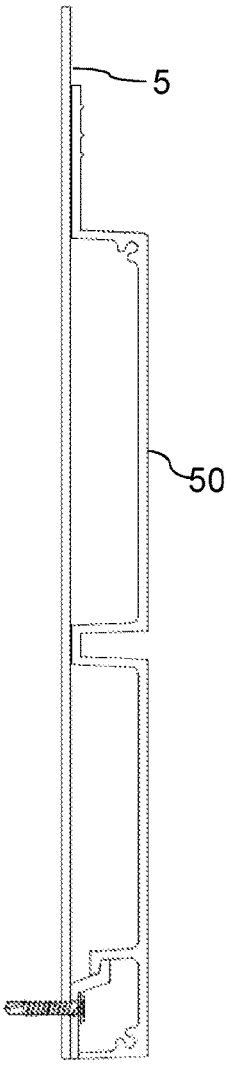

FIG. 8C shows the plank 50 installed on a plane 5. Comparing FIGS. 8A and 8C, the outward-facing contour of the plank 50 corresponds closely to the outward-facing contour that would be provided by two aligned planks 10A and 10B. Viewed from an external side (in the reading orientation of FIG. 8C, from the right), the plank 50 provides a similar visual appearance to the arrangement of FIG. 8A, while requiring only a single plank 50 to be installed to cover the given surface area covered in FIG. 8A. Note that plank 50 comprises a single attachment hook structure near the lower (lower in the reading orientation of FIG. 8C) end of the plank 50. Due to the support leg function of the rail at the lower end, the plank 50 is stably supported on the corresponding retainer until it is fixed at the shelf level by bolts.

Figure 8D:
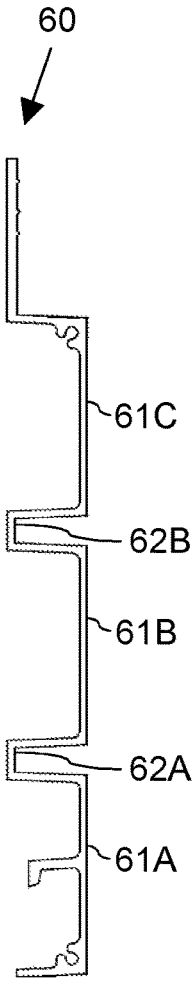

FIG. 8D shows, to provide a further example, a plank 60 comprising a plurality (here: two) facia grooves 62A and 62B that are equally spaced apart between the first facia edge and the second facia edge, to divide the facia of plank 60 into three equal facia strips 61A, 61B and 61C. The height of each facia strip 61 may correspond to the height of a facia of a single plank 10.

It can be appreciated that large planks with multiple facia strips are combinable with single-facia planks such as plank 10 shown in FIG. 2 to facilitate the cladding process by reducing the number of planks to be mounted to a walling structure.

The provision of a plank-supporting rail assists with the temporary support of larger planks, corresponding to the area covered by multiple (eg three) single planks, even if these larger planks are only supported by a single attachment hook structure at the lower end of the plank.

Figure 9:
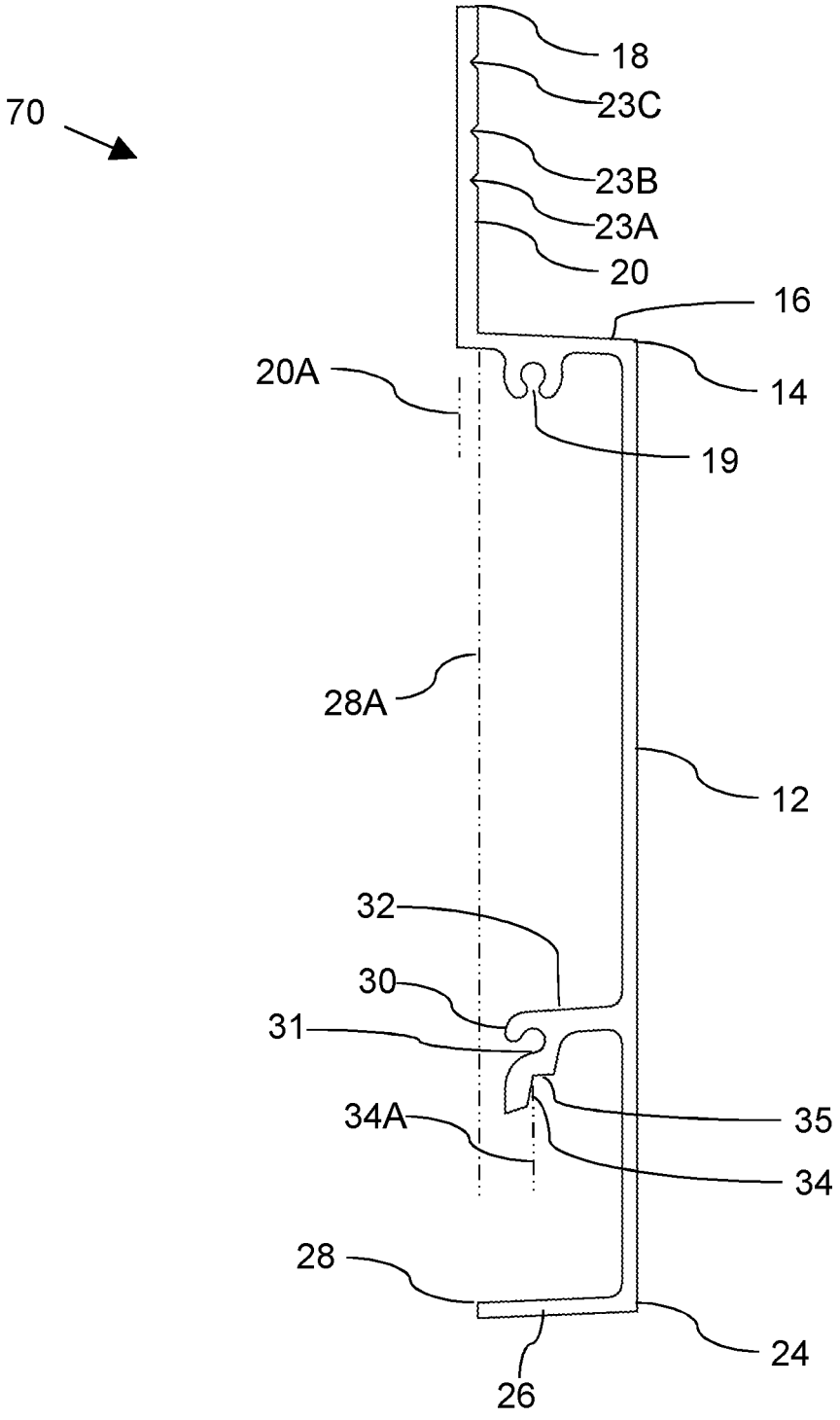
FIG. 9 shows a side view of another embodiment.

FIG. 9 shows another embodiment of a plank 70. The plank corresponds to the plank 10 described in FIG. 2 and so the same reference numerals are used for corresponding features. The description for corresponding features is not repeated for brevity. Instead of a plurality of ridges (see ridges 22 in FIG. 2), the plank 70 comprises on the shelf 20 a plurality of grooves 23A, 23B, 23C. The groove arrangement corresponds to the arrangement shown in FIGS. 5A to 6B, and lends itself, for instance, for use with a screw-type retainer.

In contrast to the FIG. 2 embodiment, the plank 70 does not comprise double-lip structures (see double-lip structures 17 and 27 in FIG. 2) in the edges between the first side wall 16 and the main surface 12, and between the second side wall 26 and the main surface 12. The plank 70 comprises a side double-lip structure 19 provided on an inside of the first side wall 16. The side double-lip structure is clear of the main surface 12 and so avoids contact with the main surface 12. The spacing from the main surface 12 is sufficient to allow a small amount of deformation of the double-lip structure 19 without it coming into contact with the main surface 12. This reduces the risk of a deformation on the main surface that may otherwise potentially occur on the facia if a fixing means is attached just behind it. The plank comprises a hook-located lip structure 31 on the leg 32. The hook-located double-lip structure 31 is clear of the main surface 12 and so avoids contact with the main surface 12. Furthermore, the hook-located double-lip structure 31 is located between the leg 32 and the first side wall 16. As and when a minor deformation occurs upon fixing a screw into the screw hole provided by the double-lip structure 31, such a deformation (if at all occurring) urges the plank toward the retainer. This prevents a potential up-lifting, or tension urging the plank 70 out of a retainer, when a screw is fixed to mount an end cover laterally onto the plank by way of the hook-located double-lip structure 31.

In embodiments with facia grooves, such as the plank 50 or 70, a double-lip structure providing a lateral screw hole may be positioned on a side wall of the facia groove. This allows a lateral screw hole to be provided without the lateral screw hole contacting the main surface, or without the structure forming the screw hole contacting the main surface upon expansion when a screw is fixed into it.

The invention claimed is:

1. A plank for an extruded plank façade system comprising a plurality of such planks as cladding suitable for a vertical walling structure, the plank being of the type comprising a facia, a joining lip, and an attachment hook structure, wherein the joining lip is recessed behind the facia and extends along a side of the facia to be at least partially overlapped by an adjacent facia of another plank to be provided and to define at least part of a joint groove between the facia and the adjacent facia, wherein the attachment hook structure extends back behind the facia to allow the plank to engage, via the attachment hook structure, a retainer fixed to the walling structure, wherein the plank further comprises a rail to at least partially conceal the attachment hook structure, and wherein the joining lip comprises a plurality of alignment features for positioning another retainer to be provided, the other retainer to be engaged by an adjacent plank, wherein the alignment features are arranged on the joining lip, and wherein each alignment feature permits a tight seating with said other retainer at different distances from the facia, such that aligning the other retainer with any one of the alignment features defines an interstitial distance of the joint groove between the facia and the adjacent facia.

2. The plank according to claim 1, wherein the rail extends back from the facia beyond the attachment hook structure, whereby, when the plank is attached to the walling structure by way of the attachment hook structure on the retainer, the rail abuts the walling structure, thereby limiting a tilt of the plank about the attachment hook structure.

3. The plank according to claim 2, wherein the attachment hook structure has a contact level with the walling structure where it attaches to the retainer, wherein the rail has a contact level with the walling structure where it contacts the walling structure, and wherein the contact levels of the attachment hook structure and of the rail are spaced apart less than the width of the joining lip.

4. The plank according to claim 1, wherein the joining lip comprises a plurality of one of lip protrusions and lip recesses, the lip protrusions and lip recesses, respectively, constituting alignment features for said retainer.

5. The plank according to claim 4, wherein the lip protrusions are provided by ridges, and/or wherein, respectively, the lip recesses are provided by grooves.

6. The plank according to claim 4, wherein the alignment features constituted by said plurality of lip protrusions and lip recesses, respectively, are unequally spaced apart with respect to the distance from the facia.

7. The plank according to claim 1, wherein the attachment hook structure comprises a retainer-engaging face that is inclined relative to the plank plane, such that, the deeper the attachment hook structure is set into the retainer, the closer the plank is held on the walling structure.

8. The plank according to claim 1, wherein the facia comprises an outer flat that, when the plank is mounted to the walling structure, faces away from the walling structure, and wherein the facia comprises on the outer flat one or more facia grooves extending parallel to the joining lip.

9. The plank according to claim 1, comprised in a plank arrangement for an extruded plank façade system further comprising said retainer, wherein the retainer comprises an attachment mechanism allowing the retainer to be fixed to a walling structure, a retaining lip for engagement with the attachment hook structure, and a spacing element defining a distance between the walling structure and the retaining lip when the plank is installed on the walling structure.

10. The plank according to claim 9, wherein the retainer comprises at least one of a retainer protrusion and a retainer recess for alignment with one of a corresponding lip recess and lip protrusion on the joining lip of the plank.

11. The plank according to claim 9, wherein the attachment mechanism comprises a bolt comprising a bolt head arrangement providing the spacing element and the retaining lip.

12. The plank according to claim 11, wherein the bolt head arrangement comprises a flange extending around at least part of the circumference of the bolt head to provide the retaining lip.

13. The plank according to claim 11, wherein the spacing element of the bolt head arrangement is provided by a portion of a shaft of the bolt.

14. The plank according to claim 9, wherein the retainer is dimensioned to be smaller than the space between the attachment hook structure and the rail, thereby avoiding interference of the retainer with the rail's abutment with an underlying walling structure when the attachment hook structure is held on the retaining lip.

15. The plank according to claim 9, wherein the retaining lip comprises an inclined plank-engaging face to engage the attachment hook structure, such that, the deeper the attachment hook structure is set into the tapered plank-engaging face, the closer the plank is held on the walling structure.

16. The plank according to claim 1, comprised in a walling structure comprising a plurality of said planks.

* * * * *